US005829069A

United States Patent [19]

Morgan et al.

[11] Patent Number: 5,829,069

[45] Date of Patent: Nov. 3, 1998

[54] JET BATH HAVING MULTIPLE ACCESSORIES

[76] Inventors: Dean W. Morgan, 419 Lake Point Dr., Marble Falls, Tex. 78564; Brad J. Roten, 4313 Dunning La., Austin, Tex. 78746

[21] Appl. No.: 625,995

[22] Filed: Apr. 1, 1996

Related U.S. Application Data

[63] Continuation-in-part of Ser. No. 352,542, Dec. 9, 1994, abandoned, which is a continuation-in-part of Ser. No. 105,961, Aug. 13, 1993, abandoned.

[51] Int. Cl.[6] ..... E04H 4/00; A47K 3/00

[52] U.S. Cl. ..... 4/493; 4/541.2; 4/559; 4/577.1; 4/678; 4/589; 219/496; 392/498

[58] Field of Search ..... 4/541.1–541.5, 4/591, 493; 219/217, 510, 511, 494, 496, 493; 392/316, 318, 333, 444, 498; 236/21 B; 362/101; 337/354, 378

[56] References Cited

U.S. PATENT DOCUMENTS

| | | | |
|---|---|---|---|
| 962,240 | 6/1910 | Neal | 4/591 |
| 3,562,692 | 2/1971 | Bletz et al. | 334/354 |
| 3,585,991 | 6/1971 | Balamuth | 4/541.1 |
| 4,361,274 | 11/1982 | Raleigh et al. | 236/21 B |
| 4,382,176 | 5/1983 | Wood | 219/494 |
| 4,419,775 | 12/1983 | Ebert | 4/541.4 |
| 4,533,894 | 8/1985 | Bishop et al. | 337/354 |
| 4,593,177 | 6/1986 | Trostler | 219/511 |
| 4,646,051 | 2/1987 | Ruszczyk et al. | 337/354 |
| 4,742,456 | 5/1988 | Kamena | 4/541.2 |
| 4,953,240 | 9/1990 | Gardenier | 4/541.3 |
| 5,000,665 | 3/1991 | Moeller | 362/101 |
| 5,079,784 | 1/1992 | Rist et al. | 4/541.4 |
| 5,101,521 | 4/1992 | Levien | 4/451.5 |
| 5,157,370 | 10/1992 | Engelbach et al. | 337/354 |
| 5,197,459 | 3/1993 | Henkin et al. | 4/541.4 |
| 5,217,292 | 6/1993 | Chalberg | 4/541.1 |

*Primary Examiner*—Henry J. Recla
*Assistant Examiner*—Gregory M. Vidovich
*Attorney, Agent, or Firm*—Joseph F. Long

[57] ABSTRACT

A jet bath designed to use minimum water, to use a formed in place low cost waterfall type water inlet, to have pulsating and massaging air-water jets appropriately located in the tub, to allow user adjustment of water temperature, to prevent heating the water above 122 degrees Fahrenheit and prevent tripping of a manually resettable high temperature limit switch with initial filling of the tub with overheated water.

5 Claims, 4 Drawing Sheets

JET BATH HAVING MULTIPLE ACCESSORIES

This is a continuation-in-part of Ser. No. 08/352,542 filed Dec. 9, 1994, now abandoned, which in turn is a continuation-in-part of Ser. No. 08/105,961 filed Aug. 13, 1993, now abandoned, having the title "A rapid-Fill, Vacuum Formable Jet Bath".

BACKGROUND OF THE INVENTION

There are several types of Whirlpool baths presently on the market that are similar to the jet bath of this invention. However, we find none with the unique features of this invention. This invention comprises unique features designed to save water, to minimize fill time, redundant controls to prevent over-heating of water, to give maximum water-air body contact, to appeal to aesthetic sensibilities, to give user control of temperature and massage action, and to be economical to manufacture. These features may be described as follows:

1. to save water and minimize fill time both tubs designed for one person and two persons use have protruding arm rests and raised portions to comfortably support each person in a comfortable reclining position: this design may be described as body contoured and results in extra comfort and minimum necessary water usage;
2. to provide an automatic over temperature shut-off system located at the exit of the water circulating pump to prevent over heating the water; the control system of this invention has, in series, a water pressure-to-close switch, a regulating thermostat that may be user adjustable with a first water temperature sensor therein and an automatic high temperature limit switch with a second water temperature sensor. The automatic high temperature limit switch closes with temperature above 122° F. to activate a thermistor to heat a manually resettable high temperature limit switch to interrupt current flow to the heater. Tripping of the manually resettable high temperature limit switch is minimized because this switch is activated by heat from the thermistor which is activated by the automatic high temperature limit switch at 122 degrees Fahrenheit. This may occur with failure of the regulating thermostat with it's self contained first water temperature sensor therein. Minimization of trips is quite important as almost universally these type electrical controls are so located as to require the user to call a repair man to correct the over temperature problem.
3. to provide a multiplicity of air-water jets with some designed to give a pulsating water flow and others designed to give a turbulent massaging action;
4. to provide an integral inlet water spout or waterfall type inlet means designed to fill the tub with a wide thin stream with an appearance of a waterfall that may have a variable color light behind to appeal to aesthetic sensibilities while being a major cost reduction factor;
5. to give user control of temperature and massage action, with the user adjusting ratio of water and air flow and in some embodiments heating of the circulating water;
6. to provide economy of manufacture by vacuum forming an outer layer using a glossy high scratch resistant plastic sheet such as one made from high temperature acrylic plastic. In a preferred embodiment a polyester-fiber glass layer is sprayed on a vacuum formed outer layer to give strength and rigidity to the tub. Special known vacuum forming techniques are used to form projections such as arm rests in order to allow the unit to be removed from the mold. In some embodiments a formable plastic composite sheet thick enough to form entire the tub is used.

SUMMARY OF THE INVENTION

The invention comprises a uniquely designed jet bath that is designed:

1. to fit the body contour for one or more occupants, this body contour shape allowing for rapid filling with less water necessary to essentially immerse an occupant or occupants;
2. to have a water proof soft pillow to support the head or heads of the occupant;
3. to use one or more types of air-water jets to give different types of massaging action;
4. to use an integral waterfall type water filling spout with no moving parts for both economy of manufacture and aesthetic beauty; a light covered with changeable colored lens may be used behind the water filling spout;
5. to controllably heat circulating water going to the air water jets in some embodiments;
6. to allow user control of the amount of air aspirated into the circulating water feeding to the air water jets to change the action of the jets;
7. to use a single element heater and controls located in a T shaped fitting exit the circulating pump; the controls include a regulating thermostat to control heating of the circulating water and an automatic high temperature limit switch to activate a thermistor to heat a manually resettable high temperature limit switch in case of malfunction of the regulating thermostat that controls heating of the circulating water to allow overheating the water;
8. to have one or more strategically located grab bars or handles;
9. for both corner and parallel to the wall installation and for an island type installation;
10. for forming the tub by vacuum molding with known reverse molding being used to form protrusions such as arm rests and waterfall filling spouts;
11. for user control of the circulating water;
12. to have high level overflow to prevent over filling;
13. to have an electronic control panel for user adjustment of variables of water flow, water temperature, and sensing of water level for automatic activation; and
14. to have space under the tub rim for all equipment previously outlined.

There are several various shapes for the rims of the tubs to allow fitting into most any user determined location with the necessary operating equipment as indicated being located under the rim of the tub to give a closed installation. A provision is made to allow water pump and heater repair or replacement.

DETAILED DESCRIPTION OF THE INVENTION

Figure 1:
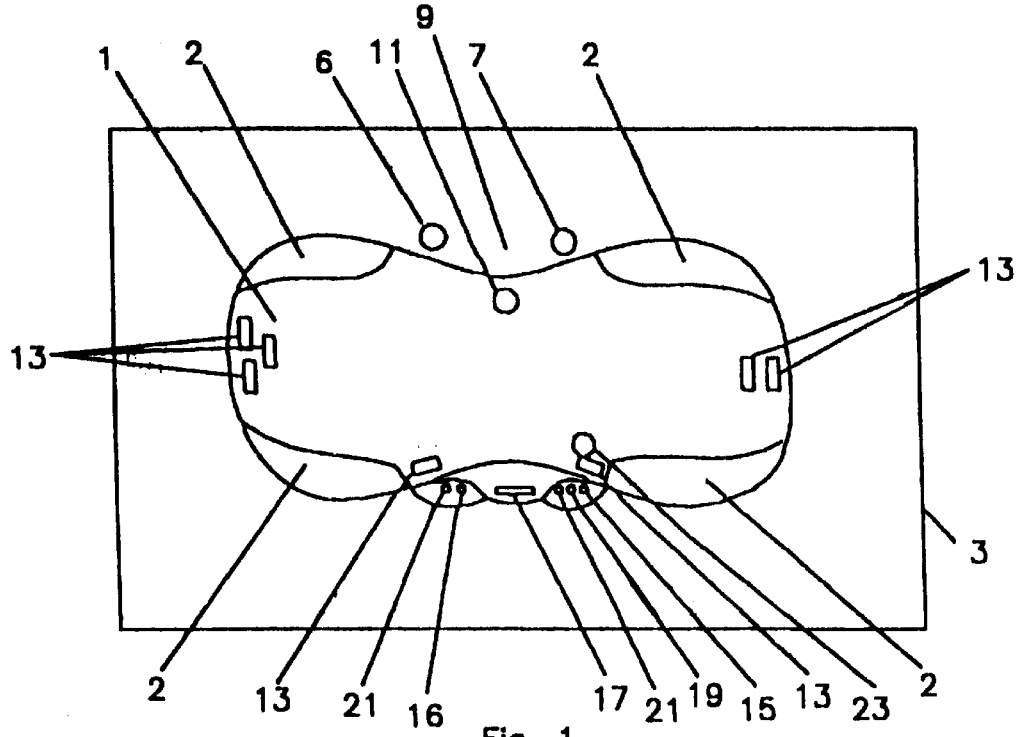
FIG. 1 is a top view of one of the embodiments.
Figure 2:
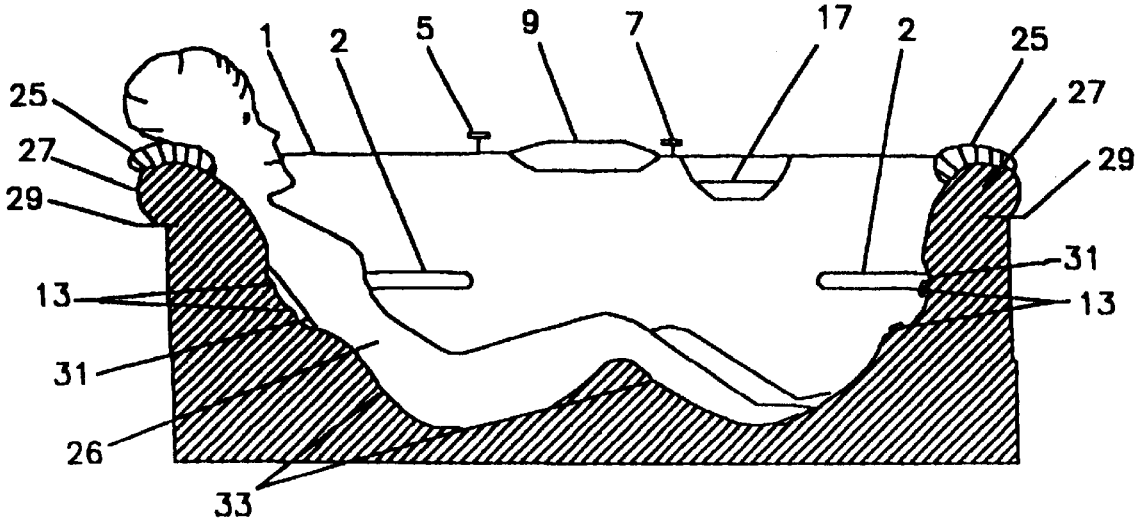
FIG. 2 is a side view indicating body contour shaping and typical air-water jet placement of one of the embodiments.
Figure 3:
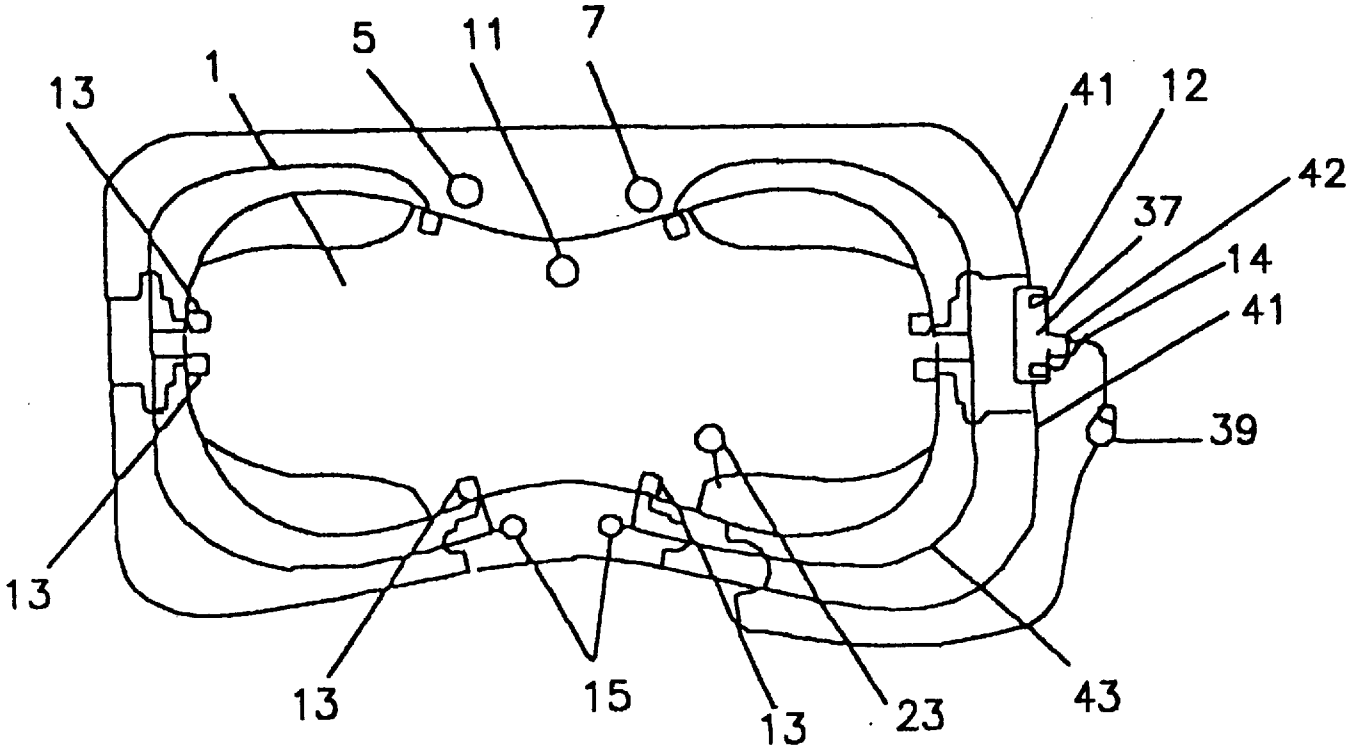
FIG. 3 top view—section below tub flange indicating water and air piping to the aspirator type air-water jets.
Figure 4:
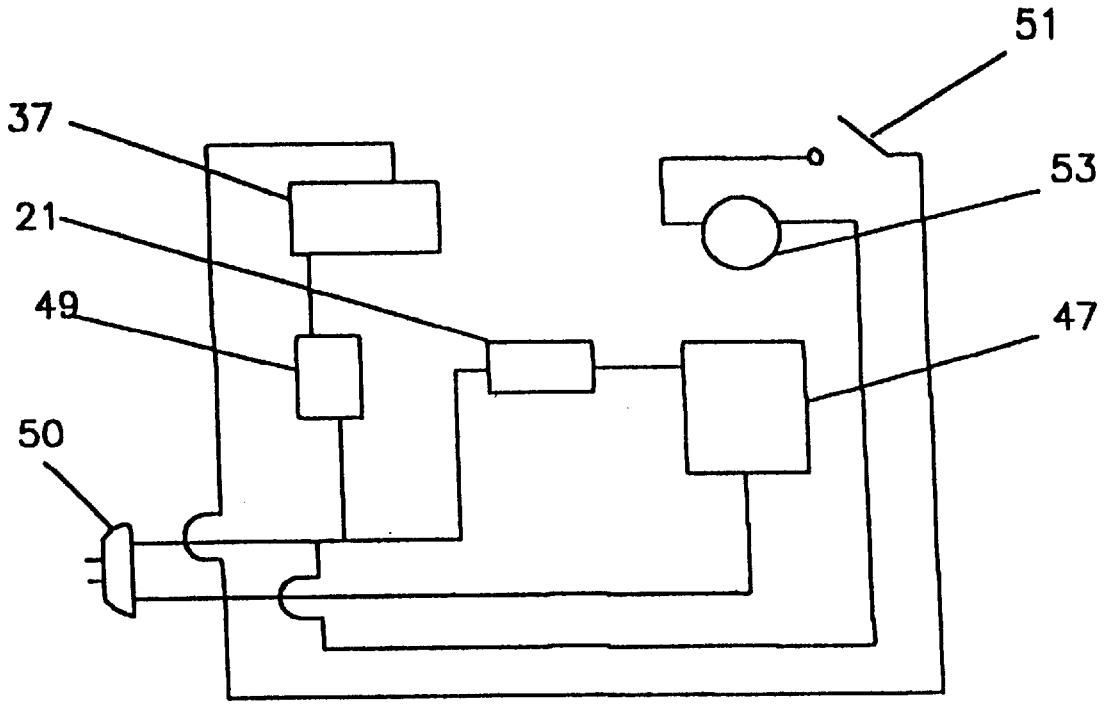
FIG. 4 is an electrical diagram for system.
Figure 6:
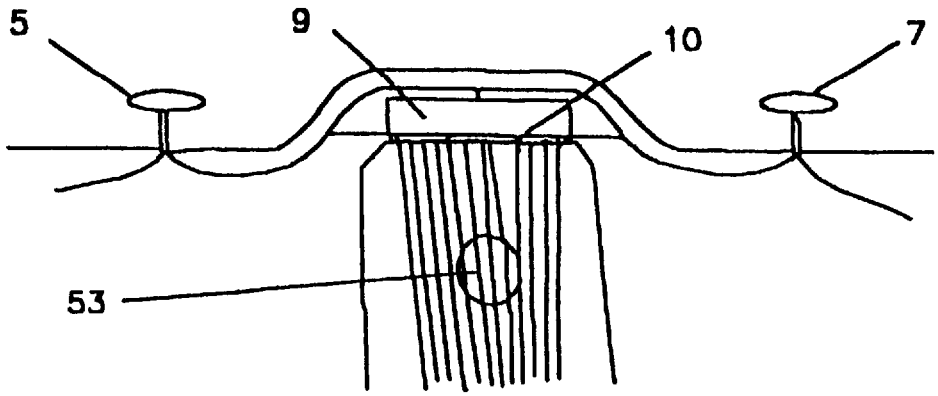
FIG. 6 shows a waterfall type inlet water spout.

The invention may best be described from the drawings. There are several embodiments with differing flanges to allow placement in corners, between walls, etc. In FIG. 1 we show a top view of a tub 1 of the jet bath. In this embodiment the flange or rim 3, which is integral with tub 1, is rectangular. Other shapes including oval, square to fit in corners, etc., would be included. This is a top view of a tub made for dual occupancy. The shape is designed to be comfortable in use and also to minimize fill time and water usage. FIG. 2, described in more detail later in conjunction with FIG. 1, indicates body contoured shaping for the purpose of supporting the body with a shape that matches the contour of the body. The tub 1 is vacuum moldable in the usual manner and a known technique called reverse molding is used to mold protruding arm rests 2 and inlet mixing chamber 9. For inlet water flow, manual valves 5 and 7 for hot and cold water adjust flow to the inlet mixing chamber 9, shown in more detail in FIG. 6. A slot or slit opening 10, FIG. 6, in this chamber 9 causes the mixed hot and cold water to exit in sheet form, as indicated in FIG. 6. This opening may be either a straight or curved slot to give a waterfall effect or various groups of small holes to give somewhat different effluent water design. This waterfall type inlet spout allows rapid filling and replaces an inlet fitting that would be much more expensive and would have to be added during installation. The tub 1 is emptied through drain 11. Aspirator type air-water jets 13 are of one or more types. In one type a rotating inlet element gives a massage like effect from the air and water mixture. In another type the air-water mixture tends to give a pushing and pulling action with a pulsating water flow. Jets that are manually directionally adjustable are preferred. Air control valves 15 are manually adjusted to limit the flow of air in header 43 as shown in FIG. 3 thereby limiting the air aspirated into the water by the aspirator type air-water jets 13. Temperature of the circulating water is adjusted by controller 19, a regulating thermostat, shown and discussed in detail under FIG. 7. Water flowrate control 21 may control water flow by either speed control of pump motor 47, as shown in FIG. 4, or by a throttling valve not shown. Shown in FIG. 3 circulating water return 23 leads to circulating pump 39.

In FIG. 2 we shown a longitudinal section through tub 1 to indicate the body contour shape of the bottom of the tub 1. We've shown tub 1 as a drop-in unit supported by external structure 29 but free standing units are also easily fabricated. The tub 1 is molded with a solid lip 27, but a hollow reinforcing lip could be used. Pillow 25 is optional to the purchaser, but is normally included. A surface sealed spongy plastic material is preferred. A person 26 is shown to indicate the body contour shape 33 of the bottom. This shape along with protruding arm rests 2 minimizes water usage to fill the tub. Depression 31 allows for use of air-water jets 13, preferably of the massage type, to work particularly near a point of usual muscle stress in people. Raised portions 33 of the tub bottom provide a body contoured shape. Arm rests 2 are formed by a known special molding technique called reverse molding to provide a smooth projection and allow removal from the mold. This type arm rest allows more body space in a similar sized tub. Hot and cold water manual valves 5 and 7 lead to mixing chamber 9 shown in more detail in FIG. 6 to form a waterfall type fill spout. Grab bar 17 is formed after the tub is removed from the mold by sealing a plastic or metal pipe about ⅞" in diameter in a molded recession. Depending on particular tub configuration there may be more than one of grab bars 17.

FIG. 3 shows section of the tub 1 below the rim from a top view to show air and water flow piping and other equipment. Circulating water pump 39 takes suction from a circulating water return port 23 and discharges through a unique T shaped unit 42 containing a single electrical heater and controls 37 which are described more completely in subsequent description of FIG. 7. Water exiting pump 39 flows into unit 42 and splits to flow into both sides of water header 41. In the unit 42 containing the heater and controls unit 37 water circulates past a water temperature sensor unit 12 that is operatively connected with an automatic high temperature limit switch 66, FIG. 7, and circulates past a second water temperature sensor 14 that is operatively connected with the regulating thermostat 19, FIG. 7. Inlet air valves 15 are manually controlled to allow adjustment of the amount of air aspirated into the aspirator type air-water jets 13. Tub drain 11 is located in lowest portion of the tub bottom.

In FIG. 4 we've shown a simplified electrical diagram of the overall system. Plug 50 connected to an electrical outlet provides current to the water circulating pump motor 47. In one embodiment motor speed is controlled through controller 21. In the circuit current is provided to heater and controls unit 37. Redundant controls provide protection of the user from excessively high temperature water and also greatly minimize the necessity for resetting a manually resettable high temperature limit switch 49, shown and described in discussion of FIG. 7. Switch 51 controls light 53 which may be located in the tub wall in back of the water flowing from the waterfall type inlet water spout 9, FIG. 6.

Figure 5:
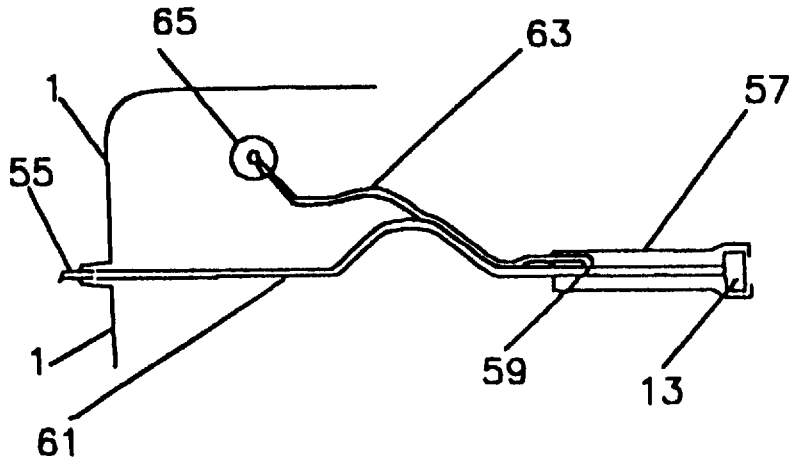
FIG. 5 shows a plug-in flexible extension for an air-water jet to allow the user to position a jet as desired.

In FIG. 5 we've shown a hand held flexible unit 57 with an aspirator type air-water jet 13 that may be manually plugged in to replace any one of jets 13 rotatably but fixedly mounted in the tub wall. The flexible tubing leading to hand held jet holder 57 is preferably co-extruded in a double lobed cross section. The double lobe cross section allows cutting with a sharp knife to form lines 61 and 63 of the length desired while having only one double lobe smooth line leading to the hand held jet holder 57. In an alternative embodiment (not shown) a manually adjustable air inlet valve is located in the body 57 of the hand held jet and line 63 is not used.

The jet in the tub wall may be manually removed and flexible tubing 61 frictionally connected over jet inlet water line 55. A separate flexible line 63 connected to vacuum cup 65 but open at the end to allow air to be aspirated in by aspirater 59 may be fastened above the water in the tub to the tub wall. The internal diameter and length of line 63 regulates the amount of air pulled into a jet 13 In a preferred embodiment, the internal diameter of line 63 is approximately one fourth inch. Vinyl plastic tubing is preferred. This plug-in unit allows the user to have a movable hand-held aspirator type air-water jet 13.

In FIG. 6 we show details of a waterfall type inlet spout 9. During manufacture, an open plastic chamber roughly in the form of a cylinder 14" long and 2" in diameter with a slotted opening 10 is formed. The cylinder is connected with the hot and cold water valves 5 and 7 and ends are formed in place with fiber glass and epoxy resin to become an integral part of the tub and to provide an inlet sheet of water through slot 10. Light 53 with replaceable colored water proof lenses may be placed in the tub wall behind outlet slot 10. Slot 10 may be straight or curved and is normally ⅛" inches wide.

Switch 51, FIG. 4, controls light 53 which may be located in the tub wall in back of the water flowing from the waterfall type inlet water spout 9.

Figure 7:
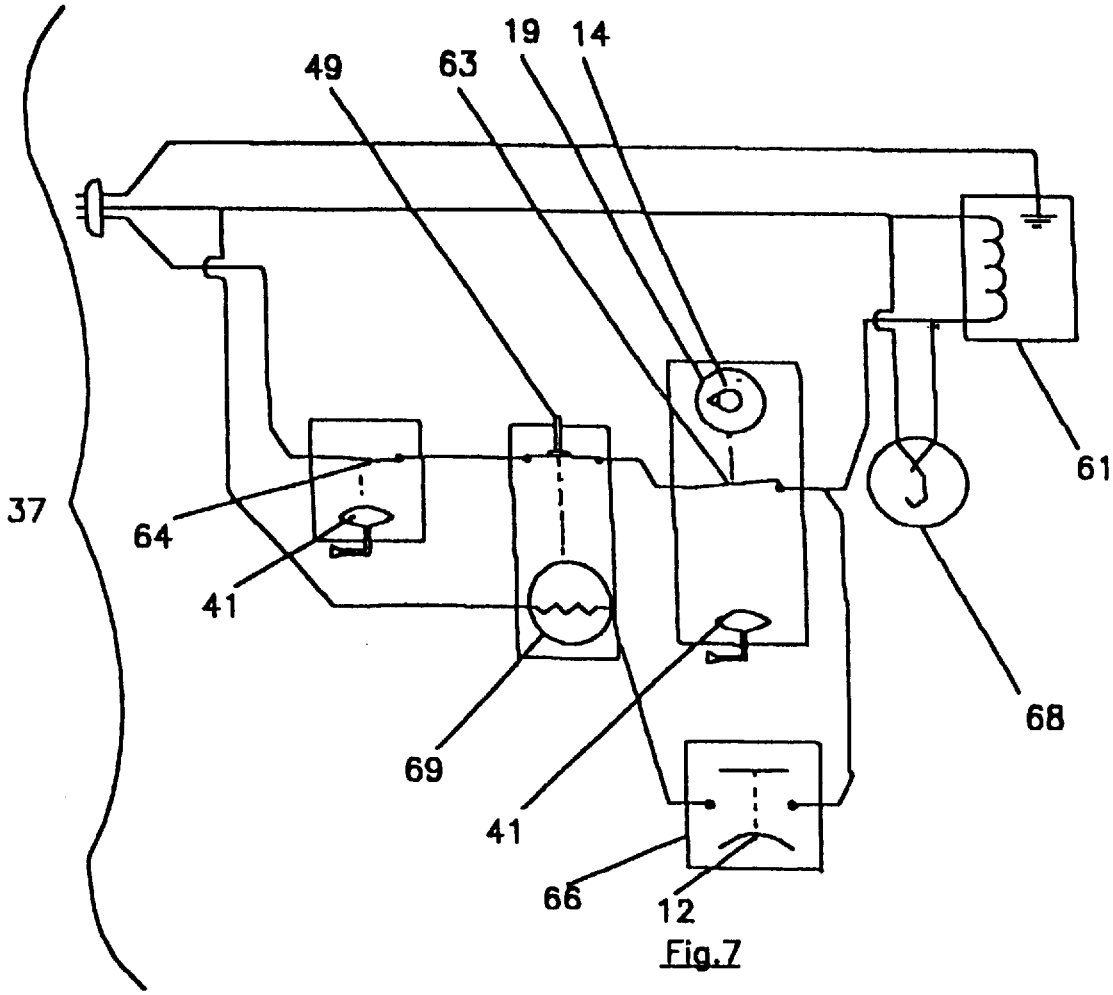
FIG. 7 shows unique circuitry inside a case for water temperature adjustment and over temperature control.

In FIG. 7 we show wiring and working parts of the unique T shaped unit 42 containing heater and controls 37. This heater and controls 37 is used only in embodiments wherein the water after filling is heated to maintain a user desired temperature. This is the minimum water usage embodiment. In other embodiments the user simply adds hot water to maintain desired temperature.

In heater and controls unit 37 a pressure to close switch 54 is activated to close by water pressure in line 41 from circulating water pump 39, FIG. 3. Waterflow in line 41 continues over the water temperature sensor 14 in an adjustable regulating thermostat 19 and over sensor 12 operatively connected with the automatic high temperature limit switch 66. Thermostat 19 activates thermostat switch 63 to open with higher than desired water temperature such as may occur from initial filling of the tub with excessively hot water. If this occurs switch 63 opens and no current flows to heater indicator light 68, to heater element 61 or through the automatic high temperature limit switch 66 to thermistor element 69. Thermistor element 69 is not heated and does not operate manually resettable switch 49 thus eliminating a false high temperature trip. However, with malfunction of regulating thermostat 19 to allow current to go the heater element 61 and water temperature to reach about 122 degrees F., water temperature sensor 12 operatively connected with the automatic high temperature limit switch 66, causes the high temperature limit switch to close to send current through and to heat thermistor element 69 to cause the manually resettable high temperature limit switch to open and prevent further current flow to heater 61.

With malfunction of the pressure switch 54 to remain closed with no water pressure, if the tub is filled with water over about 105 degrees the regulating thermostat 19 will open switch 63 and no current will flow to heater element 61 or to the automatic high temperature limit switch 66 and therefor no current will flow to the thermistor element 69 and an unnecessary tripping of the manually resettable high temperature limit switch 49 will be prevented. However if in normal operation the regulating thermostat malfunctions to allow the circulating water temperature to reach about 122 degrees Fahrenheit sensor 12 will cause the automatic high temperature limit switch to close and current will flow to heat thermistor 69 and the manually resettable high temperature limit switch 49 will trip to interrupt flow of current to the heater element 61.

If pressure switch 54 malfunctions to remain in the closed position and there is no water flow, sensors 12 and 14 are located close to heating element 61 in the heater and controls 37 in the T shaped unit 42 as indicated in FIG. 3 and heat from the element 61 will activate water temperature sensor 14 in the manually adjustable regulating thermostat 19 to interrupt current flow to the heater element 61. Sensor 12 may also be heated to more than 122 degrees to close the automatic high temperature limit switch 66 to allow current to flow through thermistor 69 to trip the manually resettable high temperature limit switch. We have then redundant controls to protect the user from over-temperature water while at the same time preventing unnecessary tripping of the manually resettable high temperature switch 49.

We visualize minor variations in the unit as outlined and wish only to be limited to the general approach rather than specific details of these specification and claims.

What is claimed is:

1. A rapid-fill vacuum formable jet bath comprising:

a) a tub; said tub having arm rests and a partially raised bottom to form a shape to fit a body in a reclining position with knees raised and to minimize water usage and filling time;

b) a waterfall type water inlet means with said waterfall type water inlet means being integrally formed in a wall of said tub by forming a chamber in said tub, connecting a hot and cold water valve to said chamber and cutting a slot type opening in said chamber, said waterfall type water inlet means acting to mix hot and cold water and to discharge a mixture of said hot and cold water through said slot type opening in said waterfall type water inlet means thereby forming a sheet of effluent water;

c) a multiplicity of aspirator type air-water jets in said tub;

d) a water circuit and a circulating water pump; said circulating water pump circulating water in said water circuit from said tub to a water inlet connection in each of said aspirator type air-water jets;

e) an adjustable regulating thermostat with a first water temperature sensor therein, and a second water temperature sensor operatingly installed in said water circuit;

f) an air header means with an adjustable air inlet to provide air to each of said multiplicity of aspirator type air-water jets;

g) an electrical heater means contained in a T shaped unit and operatively connected in said water circuit to heat water exiting said circulating water pump;

h) a control means in said T shaped unit to adjustably control current to said heater means to regulate temperature of said circulating water and to prevent overheating of said water; said control means providing redundant controls to prevent overheating of said water and consisting of:

1) an electrical circuit having said electrical heater means in said electrical circuit and a water pressure-to-close electrical switch operatively connected to said water circuit to allow current flow to said heater means in said electrical circuit when said water pressure-to-close electrical switch is held in a closed position from pressure in said water circuit;

2) a manually resettable high temperature limit switch means operatively connected in said electrical circuit, said manually resettable high temperature limit switch means further comprising a thermistor means wherein current flow to said thermistor means opens said manually resettable high temperature limit switch means thereby interrupting flow of current to said heater means;

3) said adjustable thermostat with said first water temperature sensor therein operably connected with a thermostat switch in said electrical circuit to allow current flow to said heater means to maintain a water temperature chosen by user adjustment of said adjustable thermostat; said thermostat switch being in series with said manually resettable high temperature limit switch means;

4) an automatic high temperature limit switch operatively connected with said second water temperature sensor with said second water temperature sensor operating to close said automatic high temperature limit switch at about 122 degrees Fahrenheit; said closing of said automatic high temperature limit switch allowing a current flow to said thermistor means which is operatively connected with said manually resettable high temperature limit switch means causing said manually resettable high temperature limit switch to open to interrupt said current flow to said heater means.

2. A rapid-fill vacuum formable jet bath comprising:

a) a tub means;

b) a cold water inlet valve and a hot water inlet valve in said tub means;

c) a multiplicity of aspirator type air-water jets in said tub means;

d) a water circuit with a circulating water pump operatively connected in said water circuit; said circulating water pump circulating water from said tub means to a water inlet connection in each of said aspirator type air-water jets;

e) an air header means with a manually adjustable air inlet to provide air to each of said multiplicity of aspirator type air-water jets;

f) an electrical heater means in said water circuit to heat water exiting said circulating water pump;

g) an adjustable regulating thermostat with a first water temperature sensor therein, and a second water temperature sensor in said water circuit for determining the water temperature of the water exiting said circulating water pump;

h) a control means to adjustably control current flow to said heater means to allow user adjustment of temperature of said water and to prevent overheating of said water; said control means comprising:

1) an electrical circuit having said electrical heater means in said electrical circuit and a water pressure-to-close electrical switch operatively connected to said water circuit to allow current to flow to said heater means in said electrical circuit when said water pressure-to-close electrical switch is held in a closed position by pressure in said water circuit;

2) a manually resettable high temperature limit switch means with a thermistor therein in said electrical circuit;

3) said adjustable regulating thermostat with said first water temperature sensor further having a thermostat switch therein operatively connected in said electrical circuit with said thermostat being manually adjustable to allow said current flow to said heater means to maintain a desired water temperature; said thermostat switch being in series with said manually resettable high temperature limit switch means;

4) an automatic high temperature limit switch in said electrical circuit operatively connected to said second water temperature sensor; said automatic high temperature limit switch operating to close if said water temperature rises to about 122 degrees Fahrenheit thereby allowing current to flow to heat said thermistor to trip said manually resettable high temperature limit switch means to open and interrupt said current flow to said heater means.

3. A water temperature control system for a jet bath comprising;

1) an electrical heater means in an electrical circuit;

2) a water pressure-to-close electrical switch adapted to be operatively connected to a water circuit of the jet bath to allow current to flow in said electrical circuit when said pressure-to-close electrical switch is in a closed position;

3) a manually resettable high temperature limit switch with a thermistor therein operatively connected in said electrical circuit;

4) a regulating thermostat with a water temperature sensor and a thermostat switch therein operatively connected in said electrical circuit with said thermostat regulating said current flow to said heater means to maintain a desired water temperature; said thermostat switch being electrically connected in series with said manually resettable high temperature limit switch;

5) an automatic high temperature limit switch operatively connected in said electrical circuit and operatively connected to a second water temperature sensor which is adapted to be operatively connected to the water circuit of the jet bath; said automatic high temperature limit switch operating to close if said water temperature in the water circuit rises to about 122 degrees Fahrenheit thereby allowing current to flow to said thermistor to trip said manually resettable high temperature limit switch which opens said manually resettable high temperature limit switch to interrupt said current flow to said heater means.

4. A rapid-fill vacuum formable jet bath comprising:

a) a tub; said tub having arm rests and a partially raised bottom to form a shape to fit a body in a reclining position with knees raised and to minimize water usage and filling time;

b) a hot and cold water inlet mixing means;

c) a multiplicity of aspirator type air-water jets in said tub;

d) a water circuit and a circulating water pump; said circulating water pump circulating water in said water circuit from said tub to a water inlet connection in each of said aspirator type air-water jets;

e) an adjustable regulating thermostat with a first water temperature sensor therein, and a second water temperature sensor operatingly installed in said water circuit;

f) an air header means with an adjustable air inlet to provide air to each of said multiplicity of aspirator type air-water jets;

g) an electrical heater means contained in a T shaped unit and operatively connected in said water circuit to heat water exiting said circulating water pump;

h) a control means in said T shaped unit to adjustably control current to said heater means to regulate temperature of said circulating water and to prevent overheating of said water; said control means providing redundant controls to prevent overheating of said water and consisting of:

1) an electrical circuit with said electrical heater means in said electrical circuit and a water pressure-to-close electrical switch operatively connected in said water circuit to allow current flow to said heater means in said electrical circuit when said water pressure-to-close electrical switch is held in a closed position from pressure in said water circuit;

2) a manually resettable high temperature limit switch means operatively connected in said electrical circuit, said manually resettable high temperature limit switch means further comprising a thermistor means wherein current flow to said thermistor means opens said resettable high temperature limit switch means thereby interrupting flow of current to said heater means;

3) said regulating thermostat with said first water temperature sensor therein operably connected with a thermostat switch in said electrical circuit to allow current flow to said heater means to maintain a water temperature chosen by user adjustment of said regulating thermostat; said thermostat switch being in series with said manually resettable high temperature limit switch means;

4) an automatic high temperature limit switch operatively connected with said second water temperature sensor with said second water temperature sensor operating to close said automatic high temperature limit switch at about 122 degrees Fahrenheit; said closing of said automatic high temperature limit switch allowing a current flow to said thermistor means which is operatively connected with said manually resettable high temperature limit switch means causing said manually resettable high temperature limit switch means to open to interrupt said current flow to said heater means.

5. A rapid fill vacuum formable jet bath as in claim 4 wherein said hot and cold water inlet mixing means is a waterfall type water inlet comprising a chamber formed in said tub, said chamber having a lower slot opening and openings to admit hot and cold water and acting to mix said hot and cold water and to discharge a mixture of said hot and cold water through said slot opening thereby forming a sheet of effluent water.

* * * * *